US005879106A

United States Patent [19]

Beamer

[11] Patent Number: 5,879,106

[45] Date of Patent: Mar. 9, 1999

[54] METHOD AND APPARATUS FOR CONTROLLING EXPANSION AND CONTRACTION OF TRENCH LINES HAVING LATERAL EXTENSIONS

[75] Inventor: John V. Beamer, Atlanta, Ga.

[73] Assignee: Hoosier Group, LLC, Atlanta, Ga.

[21] Appl. No.: 984,848

[22] Filed: Dec. 4, 1997

Related U.S. Application Data

[62] Division of Ser. No. 680,966, Jul. 16, 1996.

[51] Int. Cl.[6] ..... E02B 9/00; E01C 11/22

[52] U.S. Cl. ..... 405/36; 405/118; 249/11; 404/2

[58] Field of Search ..... 249/9–13; 404/2–5; 405/118–121, 150.1, 36

[56] References Cited

U.S. PATENT DOCUMENTS

| | | | |
|---|---|---|---|
| 1,468,493 | 9/1923 | Caldwell | 405/121 |
| 1,468,494 | 9/1923 | Caldwell | 405/121 |
| 1,468,495 | 9/1923 | Caldwell | 405/121 |
| 2,015,771 | 10/1935 | Waller | 405/118 |
| 2,042,350 | 5/1936 | McGuire | 405/118 X |
| 2,170,671 | 8/1939 | Adler | 405/118 |
| 2,737,778 | 3/1956 | Wold | 405/119 |
| 3,733,832 | 5/1973 | Bailey | 405/119 |
| 4,741,645 | 5/1988 | Butler | 405/118 |
| 4,787,773 | 11/1988 | Kehler | 405/118 |
| 4,940,359 | 7/1990 | Van Duyn et al. | 405/118 |
| 4,993,877 | 2/1991 | Beamer | 405/282 |
| 4,993,878 | 2/1991 | Beamer | 405/282 |
| 5,000,621 | 3/1991 | Beamer | 405/282 |
| 5,066,165 | 11/1991 | Wofford et al. | 405/119 |
| 5,181,793 | 1/1993 | Dekel | 404/4 |
| 5,213,438 | 5/1993 | Barenwald | 404/2 |
| 5,256,000 | 10/1993 | Beamer | 405/119 |
| 5,281,052 | 1/1994 | Beamer | 405/119 |
| 5,326,189 | 7/1994 | Beamer | 405/119 |
| 5,326,190 | 7/1994 | Beamer | 405/119 |
| 5,568,995 | 10/1996 | Beamer | 405/119 |
| 5,573,351 | 11/1996 | Beamer | 405/119 |
| 5,613,804 | 3/1997 | Beamer | 405/119 |

*Primary Examiner*—Tamara Graysay
*Assistant Examiner*—Tara L. Mayo
*Attorney, Agent, or Firm*—Needle & Rosenberg, P.C.

[57] ABSTRACT

A trench liner system used for forming a single or a dual containment trench where expansion and contraction of the liner is controlled. For single containment, the trench system has a primary liner or a primary liner and a separator. For dual containment, the trench system has a primary liner and a secondary liner, or a primary liner, a separator and a secondary liner. Each system also includes anchors spaced along the length of the liner so as to partition the liner into juxtaposed vertical segments. The anchors allow unimpeded contraction and expansion of the liner between anchors within a segment. These embodiments may include a holding element for holding the liners against the trench walls so as to allow each segment to expand and contract along its respective length. Another embodiment of this invention provides laterally extending cavities spaced along the length of the trench. For single or dual containment, the liners contain lateral extensions along their respective length which are disposed within the respective cavities.

20 Claims, 5 Drawing Sheets

METHOD AND APPARATUS FOR CONTROLLING EXPANSION AND CONTRACTION OF TRENCH LINES HAVING LATERAL EXTENSIONS

This application is a divisional of, and claims the benefit of, application Ser. No. 08/680,966, filed Jul. 16, 1996, which status is pending, which application is hereby incorporated herein by reference.

BACKGROUND OF THE INVENTION

1. Field of the Invention

The present invention relates to the construction industry and, more specifically, to an improved trench lining system.

2. Description of the Prior Art

The general concept of trench drainage has long been used. Trenches are used where liquid run-offs occur, such as chemical plants, food processing operations, pulp and paper mills, pharmaceutical manufacturing, bottling plants, in parking garages and parking areas of shopping centers. The fluid from a trench generally goes into a catch basin or sewer large enough to release the material from the trench as it arrives. The top of the trench is normally covered with a slotted grate to allow entrance of the fluids, catching of debris, load carrying capacity for whatever may pass over it and, in some applications, they are solidly covered, such as crossing sidewalks or where conduits are carried within the trench and fluid entry is minimal and not necessarily desirable.

The temperature of trenches may vary widely. This is due to the surrounding temperature of the ground or to the temperature of the liquid runoff. Therefore, it is essential that a trench system be able to function properly either when extremely hot or extremely cold and to withstand the changes in temperature. For example, a trench system should not block the passage of the liquid runoff as may occur under hot temperatures if the liner expands nor break and leak under extremely cold temperatures as the liner contracts.

In the prior art, worn out trenches had to be completely removed by cutting the surrounding concrete, removing all brick linings when present, removing the frames and effectively starting over again to build a new trench. In the prior art, there was no way to convert an existing trench into a dual containment trench, or to build a trench by conventional ways and at the same time turn it into a dual containment trench. In the prior art, there also does not exist a method or system for containing the expansion of trench liners.

Thus, there exists a world-wide need for an economical method to line a trench into a single or double containment trench.

There also exists a need for a system to renew a trench without replacing it in its entirety.

There also exists a need to provide a means to control the expansion and contraction of trench liners.

There also exists a need for a system which can be rapidly installed, thereby decreasing plant down time.

SUMMARY OF THE INVENTION

The disadvantages of the prior art are overcome by the present invention, which relates to a grate or solid covered trench which is to be replaced or constructed by conventional means.

The present invention is a trench liner system for forming a single or dual containment trench and for relining an existing trench having at least two walls and a bottom. One embodiment for a single containment trench comprises a primary liner means, with an interior surface and an exterior surface, extending along the length of the trench and disposed within the trench. This embodiment may include a means disposed between the primary liner means and the trench walls for separating the exterior surface of the primary liner means from the trench walls. For a dual containment trench, one embodiment comprises a secondary liner means, with an interior surface and an exterior surface, extending along the length of the trench; and a primary liner means, having an interior surface and an exterior surface, disposed within the trench within the secondary liner means and extending along the length of the trench. This embodiment may also include a means disposed between the secondary liner means and the primary liner means for separating the interior surface of the secondary liner means from the exterior surface of the primary liner means.

All these embodiments include an anchoring means for attaching the liner means and/or the separator to the trench walls. The anchoring means is spaced along the length of the trench so as to partition the liner means or the liner means and the separating means into juxtaposed vertical segments. The anchoring means may comprise a member transversely disposed across at least a portion of the primary liner means. This member may extend from one of the upper portions of the primary liner means to the opposed upper portion or may include two sections, each section being disposed adjacent each of the upper portions of the primary liner means.

Another embodiment for the anchoring means may comprise a member having a side imbedded in the trench wall, a support surface protruding from or flush with the trench wall, and a means for attaching the support surface to the liners or to the separating means. This embodiment of the anchoring means is spaced along the length of the trench wall so as to partition the liner means or the liner means and the separating means into juxtaposed vertical segments. In a single containment trench, either the primary liner is attached to the support surface or the separating means is attached to the support surface and the primary liner means is attached to the separating means. For a dual containment trench, the secondary liner is attached to the support surface. If no separating means is used, the primary liner means is attached to the secondary liner means. If a separating means is used, the separating means is attached to the secondary liner means and the primary liner means is attached to the separating means. Attachment of the various elements can be made using a bonding agent such as an adhesive or a chemical compound.

In yet another embodiment, the anchoring means is a means for attaching at least a portion of the exterior surface of the liner means or the separator means to the trench walls. The anchoring means is therefore disposed between the exterior surface of the liner means or the separator means and the trench wall. Attachment can be made by welding or by using a bonding agent. As with the anchoring means described in the previous paragraph, the various parts of the trench system are then attached to each other, thereby securing the liner means to the trench walls.

All the embodiments described may also include a means for holding the primary liner means and the separating means or the primary liner means, the separating means, and the secondary liner means against the trench walls so as to allow each segment of the primary liner means to expand and contract along its respective length. The separating means and holding means are basically the same as those disclosed in my copending applications Ser. No. 08/287,654 filed on Aug. 9, 1994; Ser. No. 08/349,901 filed on Dec. 6, 1994; Ser. No. 08/404,586 filed on Mar. 15, 1995; and Ser. No. 08/584,170 filed on Jan. 11, 1996.

Yet another embodiment of this invention is a system and method for lining a trench having at least two walls and a bottom. In this embodiment, the walls and the bottom of the trench further define laterally extending cavities spaced along the length of the trench, each cavity being in communication with the trench. For a single containment trench, the primary liner means further comprises a plurality of lateral extensions spaced along its length. Each lateral extension is disposed within a respective cavity for directing expansion of the primary liner means further into the cavity when the primary liner means expands along its length and for storing at least a portion of the primary liner means when the primary liner means contracts along its length. For a dual containment trench, the secondary liner means further comprises lateral extensions spaced along the length of the secondary liner means. Each lateral extension is disposed within a respective cavity and each lateral extension of the primary liner means is disposed within a respective lateral extension of the secondary liner means. These embodiments also may include an anchoring means as described above that partitions the primary liner means and/or the secondary liner means into juxtaposed vertical segments. These embodiments may also include a means for holding the primary liner means and/or the secondary liner means so as to allow each segment to expand and contract along its respective length.

The holding means for these embodiments are also the same as those disclosed in my copending applications Ser. No. 08/287,654 filed on Aug. 9, 1994; Ser. No. 08/349,901 filed on Dec. 6, 1994; Ser. No. 08/404,586 filed on Mar. 15, 1995; and Ser. No. 08/584,170 filed on Jan. 11, 1996.

The present invention also comprises a method of lining an existing trench, having a bottom and two vertical walls. To line a single containment trench, a primary liner means is placed along the length of the trench or a separator means and a primary liner means is placed along the length of the trench. The liner means and/or the separator means is then attached to the trench walls, thereby creating juxtaposed vertical segments. For a dual containment trench, a secondary liner is first placed in the trench. A separating means may be then be disposed within the secondary liner and the primary liner is disposed within the separating means, if used, or within the secondary liner means. The liner means and/or the separating means is then attached to the trench walls so as to form juxtaposed vertical segments.

Another embodiment of a method of lining a trench having a bottom, two vertical walls includes forming laterally extending cavities along the trench walls and bottom, the cavities being in spaced relationship along the length of the trench. For a single containment trench, a primary liner means with lateral extensions is placed within the trench. Each lateral extension is disposed within a respective cavity. For a dual containment trench, a secondary liner means with lateral extensions is placed within the trench. Each lateral extension of the secondary liner means is disposed within a respective cavity. The primary liner means with lateral extensions is then placed within the secondary liner means, and the lateral extensions of the primary liner means are then disposed within the respective lateral extension of the secondary liner means.

The trench containment unit is extremely flexible along its length, allowing continuous walls with no joints for two hundred feet or more. The trench containment unit should be an unbroken unit as long as possible to minimize the number of joints which might leak. The primary and secondary liners can have a neutral grade or be sloping as needed. Without an anchoring means, where long trenches occur, there will be expansion of the trench liner beyond the length of the trench. This expansion and subsequent contraction is controlled by anchoring the liner means to the trench walls at intervals throughout the length of the trench. Additionally, accommodations for added length, turns, and intersections may be added as needed.

Therefore, it is an object of the present invention to provide an improved lining system and method for lining a containment trench.

It is also an object of the present invention to provide a means to renew a trench without replacing it in its entirety.

It is also an object of the present invention to provide a system and method for controlling expansion and contraction of the liner means.

These and other objects will become apparent from the following description of the preferred embodiment taken in conjunction with the following drawings, although variations and modifications may be effected without departing from the spirit and scope of the novel concepts of the disclosure.

DETAILED DESCRIPTION OF THE PREFERRED EMBODIMENTS

Figure 1A:
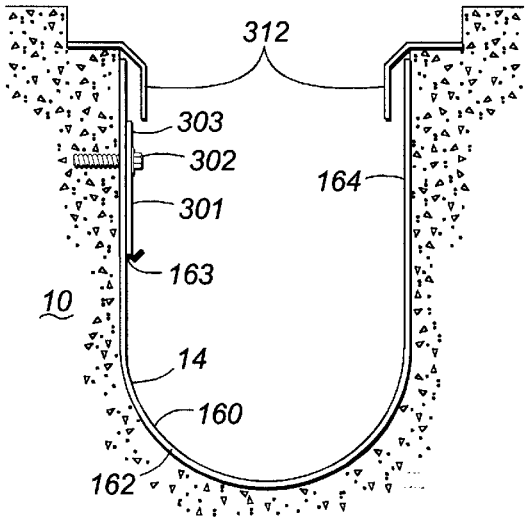
FIG. 1A is a cross sectional view of a single containment trench with an anchoring means that is transversely disposed.

A preferred embodiment of the invention is now described in detail. Referring to the drawings, like numbers indicate like parts throughout the views.

The present invention is basically the trench liner systems described in my copending applications Ser. No. 08/287,654 filed on Aug. 9, 1994, now U.S. Pat. No. 5,573,351; Ser. No. 08/349,901 filed on Dec. 6, 1994, now U.S. Pat. No. 5,568,995; Ser. No. 08/404,586 filed on Mar. 15, 1995, now U.S. Pat. No. 5,613,804; and Ser. No. 08/584,170 filed on Jan. 11, 1996, with the addition of an anchoring means.

In the trench liner systems of my copending applications, the liner means are not attached to each other, or to the separating means or to the trench walls which means the liner means expand and contract independently from each other along their lengths. With these systems, expansion and contraction of the liner means is unimpeded throughout the trench.

This invention controls the expansion and contraction of the liner means by anchoring the liner means to the trench walls. The anchors are installed at intervals throughout the trench system, delineating segments within the trench system. This allows unimpeded contraction and expansion of the liner means only between anchors within a segment of the trench system. Therefore, contraction or expansion within one segment of the trench does not spill over onto another segment of the trench system. Controlling the expansion and contraction of the trench system in segments makes it less costly by eliminating or decreasing the number of expansion and contraction cavities.

There are numerous embodiments of the present invention which have been divided into three groups of trench liner systems: (1) those with no separators means; (2) those with separators means; and (3) those with lateral extensions. Furthermore, as explained in detail below, there are four types of anchoring means: (1) a transverse member; (2) a segmented transverse member; (3) an imbedded member; and (4) an adhesive. Each of the four anchoring means may be used with any of the three trench liner systems.

FIG. 1A shows a preferred embodiment of the present invention 10, a multi-walled trench. It comprises a primary liner means 14 which rests within an existing trench having two opposed walls and a bottom. The primary liner means 14 has opposed upper portions 163 and 164, interior surface 160 and an exterior surface 162, disposed along the length of the trench. It comprises a flexible material (i.e. plastic, metal, or any other flexible material) that is resistant to the fluids which the trench is designed to hold. The primary liner means 14 is attached to the trench walls by an anchoring means 301.

Figure 4A:
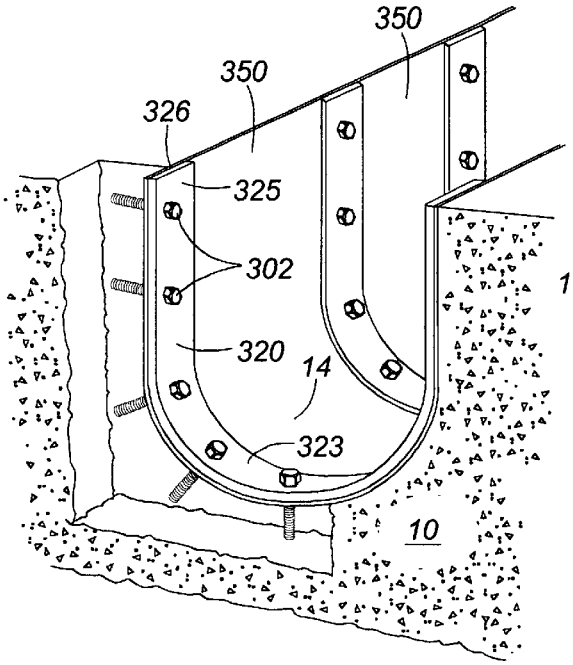
FIG. 4A is a perspective view of a trench assembly with a strap belt.
Figure 4B:
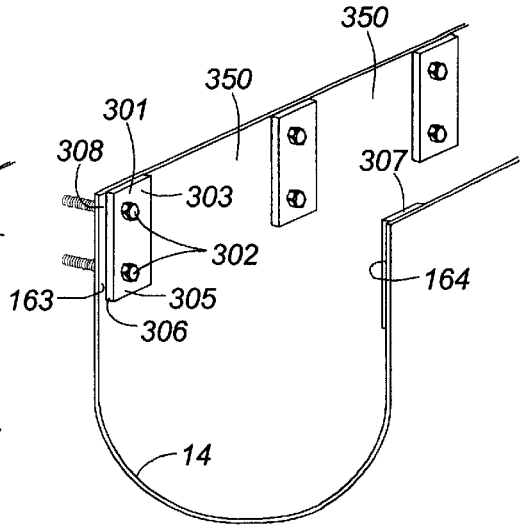
FIG. 4B is a perspective view of a trench assembly with an anchoring means that is transversely disposed.

One embodiment of the anchoring means 301 is shown in FIG. 1A and in more detail in FIG. 4B. It comprises a member 303 transversely disposed across at least a portion of the primary liner means 14 having a first surface 305 open to the interior of the trench and an opposed second surface 306 in contact with at least a portion of the interior surface 160 of the primary liner means 14. Each member may have two sections 307 308, each section being disposed adjacent each of the upper portions 163 164 of the primary liner means 14. The member 303 defines at least one opening therethrough adapted to receive therein a bolt 302 to secure the primary liner means 14 to the trench walls. The anchoring means 303 is spaced along the length of the trench so as to partition the primary liner means 14 into a plurality of juxtaposed vertical segments 350.

This embodiment may include a holding means 312 adapted to hold the primary liner means 14 against the trench walls so as to allow each segment 350 of the primary liner means 14 to expand and contract along its respective length. Embodiments of the holding means 312 are described in my copending applications Ser. No. 08/287,654 filed on Aug. 9, 1994, now U.S. Pat. No. 5,573,351; Ser. No. 08/349,901 filed on Dec. 6, 1994, now U.S. Pat. No. 5,568,995; Ser. No. 08/404,586 filed on Mar. 15, 1995, now U.S. Pat. No. 5,613,804; and Ser. No. 08/584,170 filed on Jan. 11, 1996.

Figure 1B:
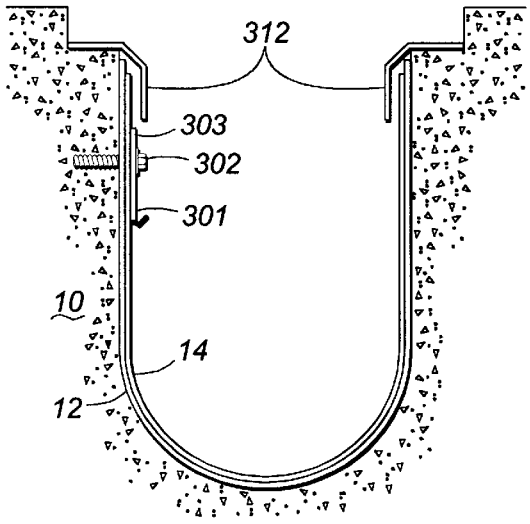
FIG. 1B is a cross sectional view of a double containment trench with an anchoring means that is transversely disposed.

The trench liner system shown in FIG. 1B includes a secondary liner means 12 making it a double containment trench. In this embodiment, the secondary liner means 12 is disposed within and along the length of the trench, with the primary liner means 14 being disposed within the secondary liner means 12. The secondary liner means 12 also comprises a material that is resistant to the fluids which the trench is designed to hold. To control the expansion and contraction of the liner means 12 and 14, this embodiment also includes an anchoring means 301 as shown in detail in FIG. 4B and as explained for FIG. 1A The anchoring means 301 anchors both the primary liner means 14 and the secondary liner means 12 to the trench walls so as to partition the primary liner means 14 into juxtaposed vertical segments 350. A holding means 302 may be used to hold the liners 12, 14 to the trench walls so as to allow each segment of the liner means to expand and contract along their respective lengths.

Figure 1C:
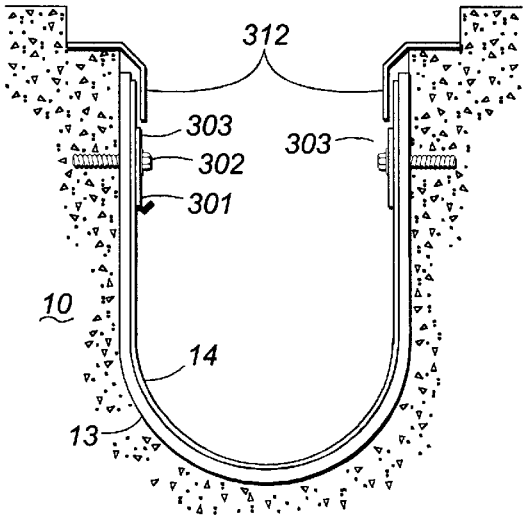
FIG. 1C is a cross sectional view of a single containment trench with a separator means and an anchoring means that is transversely disposed.
Figure 1D:
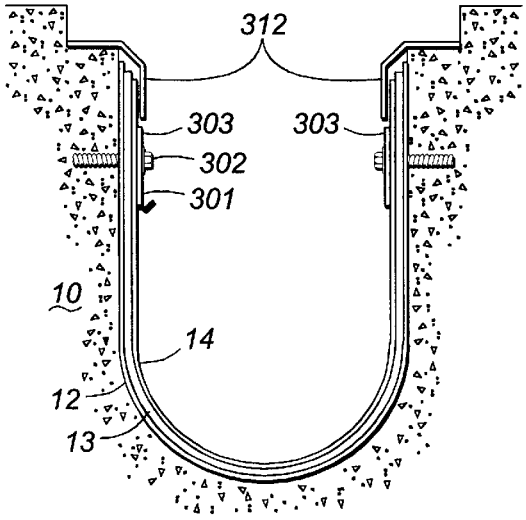
FIG. 1D is a cross sectional view of a double containment trench with a separator means and an anchoring means that is transversely disposed.

FIGS. 1C and 1D show another type of trench liner system that includes a separating means 13. The separating means 13 is disposed within the trench for single containment as shown in FIG. 1C or within the secondary liner 12 for double containment as shown in FIG. 1D. The separating means 13 is the same as described in my copending applications Ser. No. 08/287,654 filed on Aug. 9, 1994, now U.S. Pat. No. 5,573,351; Ser. No. 08/349,901 filed on Dec. 6, 1994, now U.S. Pat. No. 5,568,995; Ser. No. 08/404,586 filed on Mar. 15, 1995, now U.S. Pat. No. 5,613,804; and Ser. No. 08/584,170 filed on Jan. 11, 1996.

The primary liner means 14 is disposed within the separating means 13. To control expansion and contraction, an anchoring means in the form of a segmented member 303, as described for FIG. 1A and also shown in FIG. 4B, is used to anchor the primary liner means and the separating means to the trench walls, as shown in FIG. 1C, or to anchor the secondary liner means, the separating means, and the primary liner means as shown in FIG. 1D to the trench walls.

Figure 2A:
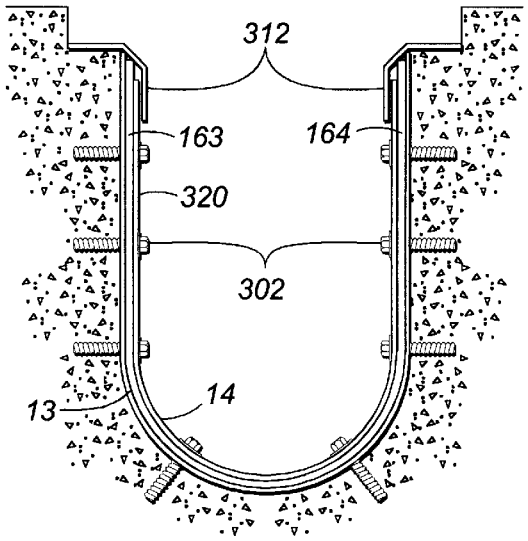
FIG. 2A is a cross sectional view of a single containment trench with a separator means and an anchoring means that is transversely disposed.
Figure 2B:
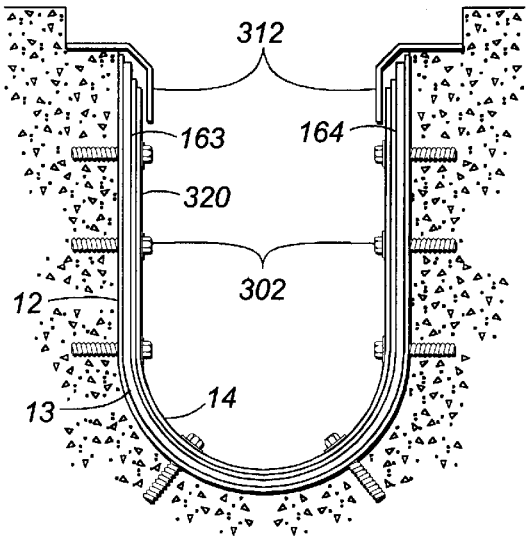
FIG. 2B is a cross sectional view of a double containment trench with a separator means and an anchoring means that is transversely disposed.

FIGS. 2A and 2B show a trench liner system with a separator and a transverse member 320 that extends from one of the upper portions of the primary liner means 163 to the opposed upper portion 164. The trench liner system can be a single containment trench with a separator as explained for FIG. 1C or a double containment trench with a separator as explained for FIG. 1D.

A transverse member 320 that extends from one of the upper portions 163 to the opposed upper portion 164 is shown in FIG. 2A–2B and in more detail in FIG. 4A. It comprises a transverse member 323 having a first surface 325 open to the interior of the trench and an opposed second surface 326 in contact with the interior surface of the primary liner means 14 extending from the upper portion 163 to the opposite upper portion 164 of the primary liner means 14. The member 320 defines at least one opening adapted to receive a bolt 302 passing through, thereby securing the primary liner means 14 to the trench walls.

In FIG. 2A, a single containment trench is shown and therefore the member 320 holds the primary liner means 14 and the separator means 13 to the trench walls. In FIG. 2B a double containment trench is shown and therefore the member 320 holds the primary liner means 14, the separator means 13 and the secondary liner means 12 to the trench walls.

Figure 2C:
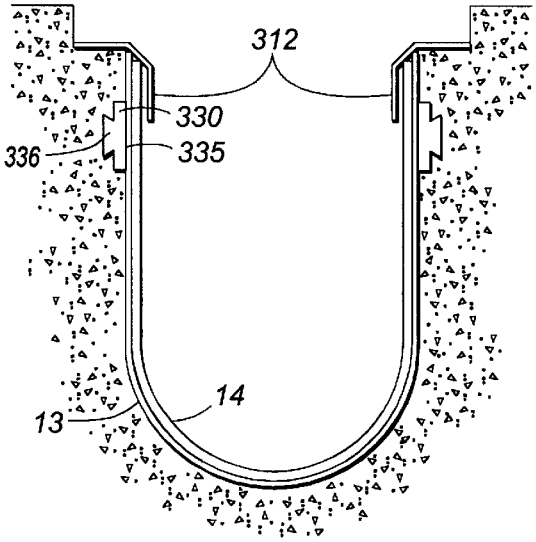
FIG. 2C is a cross sectional view of a single containment trench with a separator means and an imbedded anchoring means.
Figure 2D:
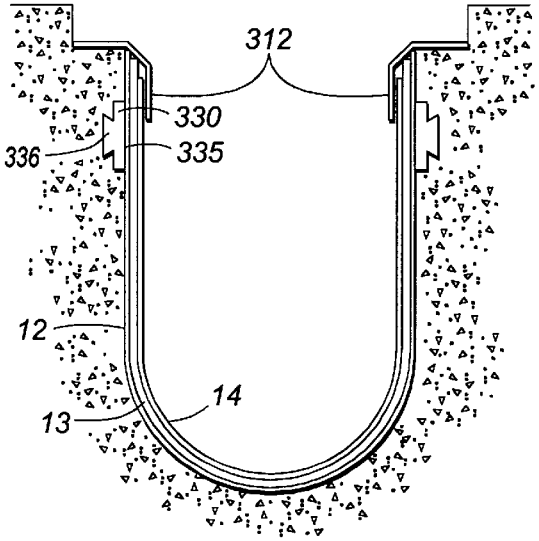
FIG. 2D is a cross sectional view of a double containment trench with a separator means and an imbedded anchoring means.
Figure 4C:
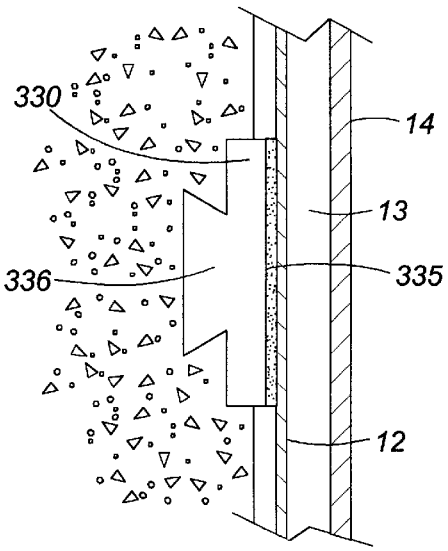
FIG. 4C is a cross sectional view of an imbedded anchoring means.

FIGS. 2C and 2D show a single containment trench with a separator and a double containment trench with a separator where the anchoring means is member 330. As shown in detail in FIG. 4C, the member 330 has a side 336, a support surface 335, and a means for attaching the support surface 335 to the exterior surface of the primary liner. The side 336 of member 330 is embedded in the trench wall. The support surface 335 can be flush with the trench wall or protrude therefrom into the trench opening. A means for attaching, such as an adhesive, is disposed between the support surface 335 and the primary liner 14. As shown in FIG. 2C, for a single containment trench, the separator means 13 is adhered to the support surface 335 of the anchor 330. Adherence can also be made by welding or bonding the support surface 335 to the separating means 13. The primary liner means 14 is also adhered to the separator means 13, thereby attaching the primary liner means 14 and the separator means 13 to the trench walls.

For double containment, as shown in FIG. 2D, the secondary liner 12 is attached to the support surface 335 of the anchor 330. The separator means 13 is adhered to the secondary liner 13 and the primary liner means 14 is adhered to the separator means 13. Thus, the secondary liner means 12 the separator means 13 and the primary liner means 12 are attached directly or indirectly to the trench walls.

Figure 3A:
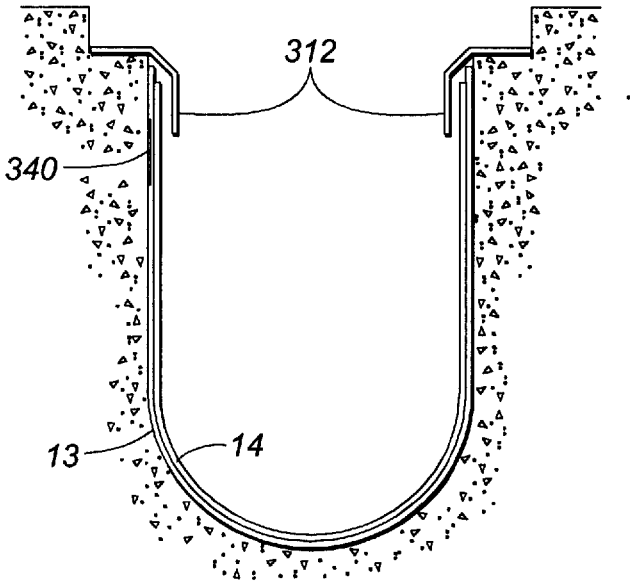
FIG. 3A is a cross sectional view of a single containment trench with a separator means and an anchoring means that is a bonding agent.
Figure 3B:
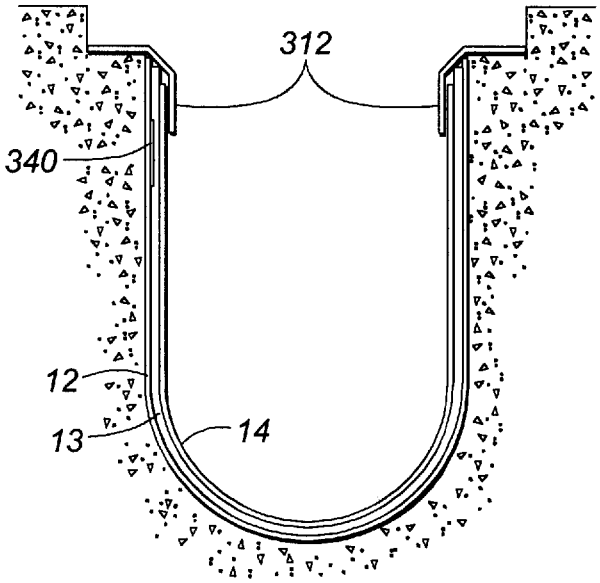
FIG. 3B is a cross sectional view of a double containment trench with a separator means and an anchoring means that is a bonding agent.
Figure 4D:
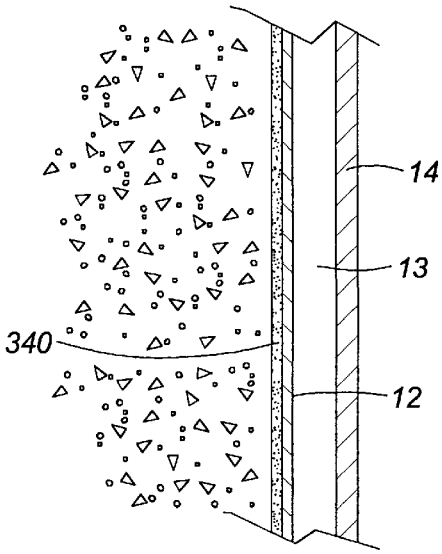
FIG. 4D is a cross sectional view of an anchoring means that is a bonding agent.

FIG. 3A and 3B show a single and double containment trench where the anchoring means comprises a bonding agent. As shown in detail in FIG. 4D, the bonding agent 340 can be glue or a chemical compound disposed between at least a portion of the trench walls and at least a portion of the liner means. For single containment as shown in FIG. 3A, the separator means 13 is adhered to the trench walls by the bonding agent 340. The primary liner means 14 is also adhered to the separator means 13 using a bonding agent, thereby attaching the separator means 13 and the primary liner means 14 to the trench walls. For dual containment, as shown in FIG. 3B, and in detail in FIG. 4D, the secondary liner means 12 is attached to the trench walls using a bonding agent 340. The separator means 13 is attached to the secondary liner means 12 using a bonding agent or adhesive and the primary liner means 14 is also adhered to the separator means 13 using an bonding agent or adhesive, thus attaching the secondary liner means 12 the separator means 13 and the primary liner means 14 to the trench walls.

Figure 5A:
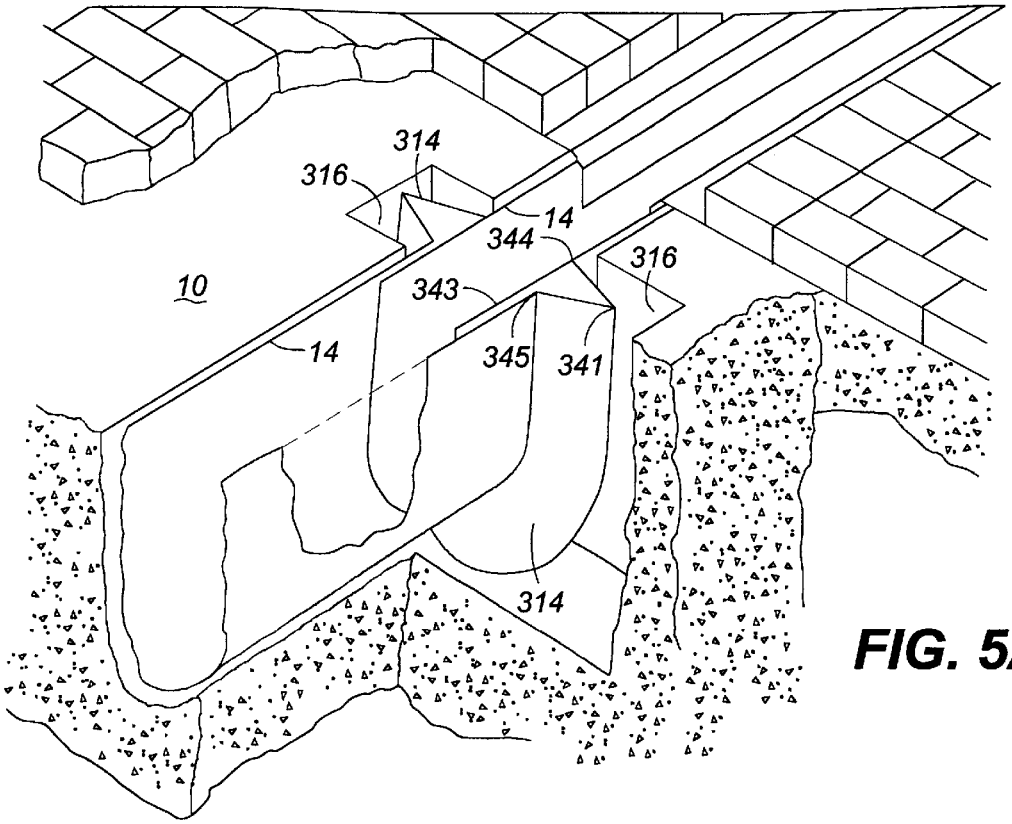
FIG. 5A is a perspective view of a single containment trench with expansion and contraction cavities.
Figure 5B:
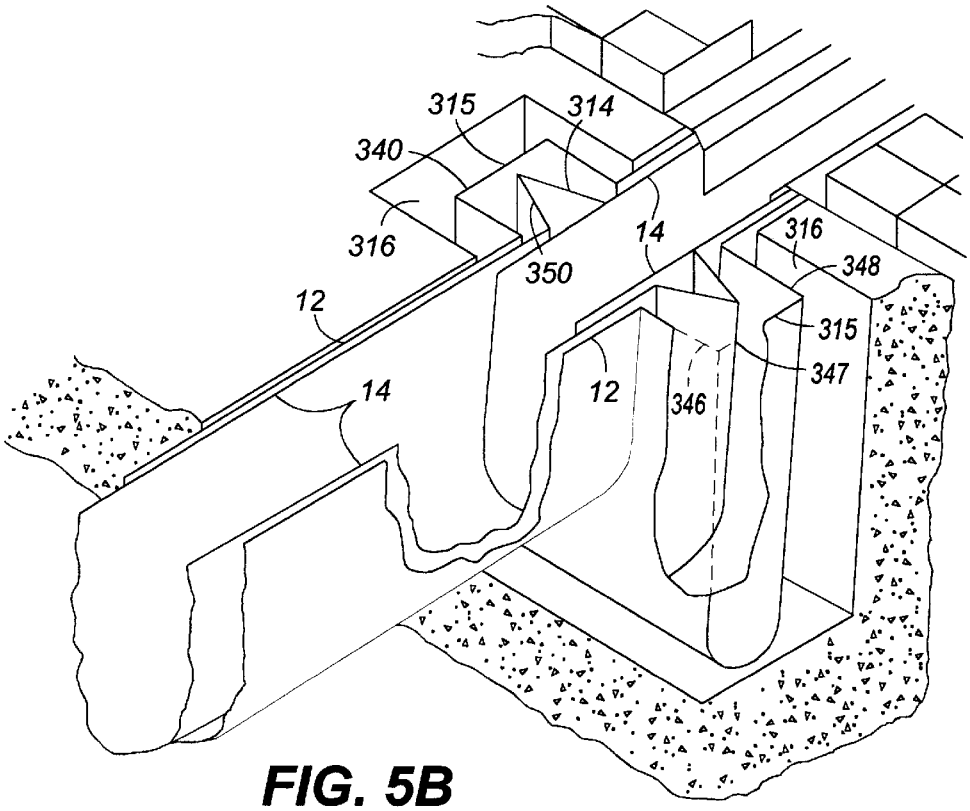
FIG. 5B is a perspective view of a double containment trench with expansion and contraction cavities.

FIG. 5A and 5B show another embodiment for controlling expansion and contraction of the liner means. These embodiments include a trench with walls and a bottom that define laterally extending cavities 316 along the length of the trench. Each cavity 316 is in communication with the trench. The primary liner means 14 includes lateral extensions 320 which are disposed within a respective cavity 316 for directing expansion of the primary liner means 14 further into the cavity when the primary liner means 14 expands along its length and for storing at least a portion of the primary liner means 14 when the primary liner means contracts along its length.

For single containment as shown in FIG. 5A, the lateral extensions 320 are pleats 314 having a fold 341, two opposed open ends 344, 345 defining an opening that is flush with the interior surface of the primary liner means 14, and a flap 343 covering the opening defined by the two open ends 344, 345. The fold 341 of the pleat 314 of the primary liner means 14 protrudes into the cavity 316. As the primary liner 14 contracts, the length of the primary liner means 14 shortens and the open ends 344 345 of each pleat 314 are pulled apart. As the primary liner means 14 expands, the length of the primary liner means 14 lengthens and the extra material is directed into the cavity 316. In other words, the open ends 344, 345 of each pleat 314 come together and the opening is made smaller. Flap 343 covers the opening of each pleat 314, thereby reducing the amount of debris that may get trapped in each pleat 314.

For dual containment, as shown in FIG. 5B, the primary liner means 14 is essentially the same as described for single-containment in FIG. 5A The secondary liner means includes lateral extensions 340, which as shown in FIG. 5*b*, may be an open box 315 formed by walls 346, 347, 348 that define an opening. The box 315 protrudes into respective cavities 316. Each pleat 314 of the primary liner means 14 is disposed within the box 315 of the secondary liner means 12. As the liner means 12 and 14 contract, each pleat 314 and each cavity 315 is pulled apart. As the liner means 12 and 14 expand, the expanded material is directed into the cavity 315.

In yet another embodiment for dual containment, the expansion and contraction means of the secondary liner can be pleats as those described for single containment except that no flap is required as the primary liner means 14 protects the opening of the pleat of the secondary liner means 12.

The above embodiments are given as illustrative examples and are not intended to impose any limitations on the invention. It will be readily appreciated that many deviations may be made from the specific embodiments disclosed in this specification without departing from the invention. Accordingly it is intended to cover all such modifications as within the scope of this invention.

What is claimed is:

1. A trench and liner system for controlling expansion and contraction of at least one trench liner within a trench, comprising:

a. a trench having at least one laterally extending cavity;

b. a primary liner disposed within and extending substantially along the length of the trench; and c. at least one flexible lateral extension formed in the primary liner, each lateral extension being disposed within a respective cavity and allowing expansion and contraction of the primary liner.

2. The system of claim 1, wherein the at least one lateral extension of the primary liner comprises a pleat having a fold, two opposed ends defining an opening, and a flap covering the opening; wherein the fold protrudes into the respective cavity, and the opposed ends are pulled apart as the primary liner contracts, and the opposed ends come together as the primary liner expands.

3. The system of claim 1, further comprising a secondary liner disposed within the trench between the trench and the primary liner, the system further comprising at least one lateral extension formed in the secondary liner, each lateral extension of the secondary liner being disposed within a respective cavity, the lateral extension of the secondary liner extending further into the cavity when the secondary liner expands, and retracting from the cavity when the secondary liner contracts, each lateral extension of the primary liner being disposed within a respective lateral extension of the secondary liner.

4. The system of claim 3, wherein the at least one lateral extension of the secondary liner comprises a box-like extension having three walls defining an opening, and wherein the at least one lateral extension of the primary liner comprises a pleat having a fold, two opposed ends defining an opening, and a flap covering the opening, wherein the fold of the primary liner protrudes into the respective opening in the box-like extension of the secondary liner.

5. The system of claim 3, further comprising means disposed between the primary liner and the secondary liner for separating the primary and secondary liners and for allowing the primary and secondary liners to expand and contract independently from one another.

6. A liner system for lining a trench, the trench having at least one laterally extending cavity, said liner system comprising:

a. a primary liner disposed within and extending substantially along the length of the trench; and b. at least one flexible lateral extension formed in the primary liner, each lateral extension being disposed within a respective cavity of the trench and allowing expansion and contraction of the primary liner.

7. The system of claim 6, wherein the at least one lateral extension of the primary liner comprises a pleat having a fold, two opposed ends defining an opening, and a flap covering the opening; wherein the fold protrudes into the respective cavity of the trench, and the opposed ends are pulled apart as the primary liner contracts, and the opposed ends come together as the primary liner expands.

8. The system of claim 6, further comprising a secondary liner disposed within the trench between the trench and the primary liner, the system further comprising at least one lateral extension formed in the secondary liner, each lateral extension of the secondary liner being disposed within a respective cavity of the trench, the lateral extension of the secondary liner extending further into the cavity when the secondary liner expands, and retracting from the cavity when the secondary liner contracts, each lateral extension of the primary liner being disposed within a respective lateral extension of the secondary liner.

9. The system of claim 8, wherein the at least one lateral extension of the secondary liner comprises a box-like extension having three walls defining an opening, and wherein the at least one lateral extension of the primary liner comprises a pleat having a fold, two opposed ends defining an opening, and a flap covering the opening, wherein the fold of the primary liner protrudes into the respective opening in the box-like extension of the secondary liner.

10. The system of claim 8, further comprising means disposed between the primary liner and the secondary liner for separating the primary and secondary liners and for allowing the primary and secondary liners to expand and contract independently from one another.

11. A method of lining a trench comprising the steps of:

a. providing at least one laterally extending cavity within the trench;

b. placing a primary liner having at least one flexible lateral extension within the trench so that each said lateral extension is disposed within a respective cavity, whereby the at least one lateral extension allows expansion and contraction of the primary liner.

12. The method of claim 11, further comprising providing the at least one lateral extension of the primary liner with a pleat having a fold, two opposed ends defining an opening, and a flap covering the opening; wherein the fold protrudes into the respective cavity, and the opposed ends are pulled apart as the primary liner contracts, and the opposed ends come together as the primary liner expands.

13. The method of claim 11, further comprising placing a secondary liner within the trench between the trench and the primary liner, the secondary liner having at least one lateral extension formed therein, each lateral extension of the secondary liner being disposed within a respective cavity, each lateral extension of the secondary liner extending further into the cavity when the secondary liner expands, and retracting from the cavity when the secondary liner contracts, each lateral extension of the primary liner being disposed within a respective lateral extension of the secondary liner.

14. The method of claim 13, further comprising providing the at least one lateral extension of the secondary liner with a box-like extension having three walls defining an opening, providing the at least one lateral extension of the primary liner with a pleat having a fold, two opposed ends defining an opening, and a flap covering the opening, and wherein the step of placing the secondary liner comprises aligning the primary liner and the secondary liner so that the fold of the primary liner protrudes into the respective opening in the box-like extension of the secondary liner.

15. The method of claim 13, further comprising placing separating means between the primary liner and the secondary liner for separating the primary and secondary liners and for allowing the primary and secondary liners to expand and contract independently from one another.

16. A method of lining a trench having at least one laterally extending cavity, the method comprising the steps of:

a. placing a primary liner having at least one flexible lateral extension within the trench so that each lateral extension of the primary liner is disposed within a respective laterally extending cavity of the trench; and b. allowing the primary liner to expand and contract within the trench.

17. The method of claim 16, further comprising providing the at least one lateral extension of the primary liner with a pleat having a fold, two opposed ends defining an opening, and a flap covering the opening; wherein the fold protrudes into the respective cavity of the trench, and the opposed ends are pulled apart as the primary liner contracts, and the opposed ends come together as the primary liner expands.

18. The method of claim 16, further comprising placing a secondary liner within the trench between the trench and the primary liner, the secondary liner having at least one lateral extension formed therein, each lateral extension of the secondary liner being disposed within a respective cavity of the trench, each lateral extension of the secondary liner extending further into the cavity when the secondary liner expands, and retracting from the cavity when the secondary liner contracts, each lateral extension of the primary liner being disposed within a respective lateral extension of the secondary liner.

19. The method of claim 18, further comprising providing the at least one lateral extension of the secondary liner with a box-like extension having three walls defining an opening, providing the at least one lateral extension of the primary liner with a pleat having a fold, two opposed ends defining an opening, and a flap covering the opening, and wherein the step of placing the secondary liner comprises aligning the primary liner and the secondary liner so that the fold of the primary liner protrudes into the respective opening in the box-like extension of the secondary liner.

20. The method of claim 18, further comprising placing separating means between the primary liner and the secondary liner for separating the primary and secondary liners and for allowing the primary and secondary liners to expand and contract independently from one another.

* * * * *